United States Patent [19]

Aschinger

[11] 4,303,288

[45] Dec. 1, 1981

[54] DRAWER LOCKING APPARATUS FOR MERCHANDISE CABINETS

[75] Inventor: William T. Aschinger, Gahanna, Ohio

[73] Assignee: The Columbus Show Case Company, Columbus, Ohio

[21] Appl. No.: 154,789

[22] Filed: May 30, 1980

[51] Int. Cl.[3] ..... E05B 65/46

[52] U.S. Cl. ..... 312/215; 312/217; 312/220

[58] Field of Search ..... 312/215, 217, 218, 220, 312/221, 222, 107.5

[56] References Cited

U.S. PATENT DOCUMENTS

| | | | |
|---|---|---|---|
| 341,746 | 5/1886 | Hall | 312/220 |
| 554,452 | 2/1896 | Munich | 312/221 |
| 898,106 | 9/1908 | Higgins | 312/220 |
| 1,093,981 | 4/1914 | Dunleavy | 312/221 |
| 1,225,294 | 5/1917 | Weiss | 312/107.5 |
| 1,315,709 | 9/1919 | Coombs | 312/217 |
| 1,712,842 | 5/1929 | Richardson | 312/220 |
| 2,094,155 | 9/1937 | Hodgkinson et al. | 312/220 |
| 3,608,341 | 9/1971 | Galtz | 312/215 |
| 3,862,772 | 1/1975 | Latham | 312/215 |

*Primary Examiner*—Victor N. Sakran

*Attorney, Agent, or Firm*—William S. Rambo

[57] ABSTRACT

A merchandise cabinet having display and drawer bearing areas is equipped with a drawer locking apparatus comprising drawer mounted abutment means, a rigid locking frame slidably mounted for lateral movement into and out of engagement with the abutment means, and an engagement lever carried on the locking frame and extending into the path of an access door provided in the display area.

5 Claims, 6 Drawing Figures

FIG. 1
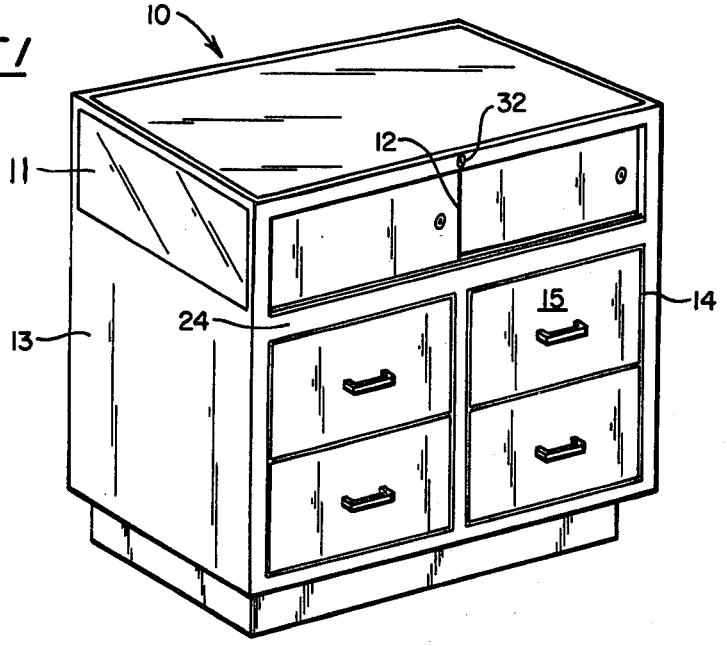
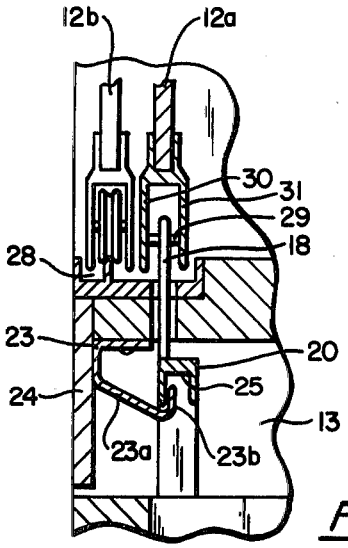
FIG. 4
FIG. 5
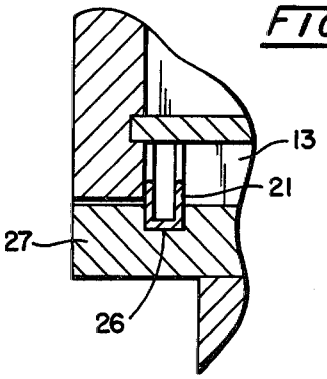
FIG. 6
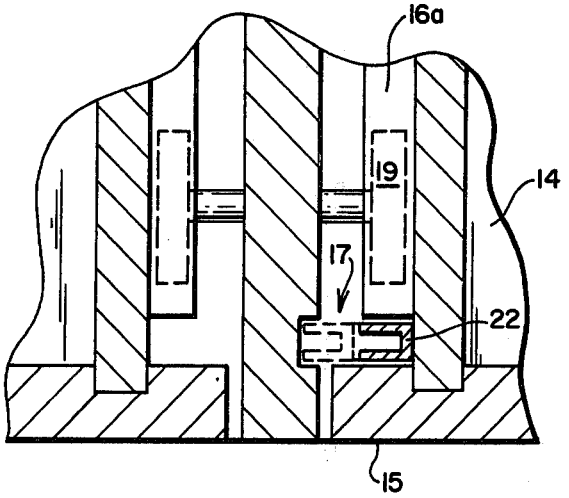

DRAWER LOCKING APPARATUS FOR MERCHANDISE CABINETS

BACKGROUND OF THE INVENTION

The present invention relates to locking mechanisms for cabinets and desks and more particularly to locking devices capable of selectively engaging and disengaging a plurality of drawers simultaneously.

In the past, multiple-drawer locking devices have called for pivotally interconnected linkages and associated hardware actuated by a key-operated latch or by a master locking drawer. Some of these prior art locks were fashioned from relatively narrow gauge rods or straps in a complex linkage pattern. U.S. Pat. No. 341,746 issued May 11, 1886 to Hall, represents the most pertinent prior art known to the applicant. The Hall patent discloses a desk drawer locking mechanism comprising a parallelogram linkage actuated by a key-locking drawer that secures all other drawers in the desk when the master locking drawer is closed. The vertical locking strips or bars of the mechanism move laterally into grooves or recesses formed in the rear portions of the drawers to lock the same. However, the locking system of the aforesaid Hall patent involves a kinematic linkage materially more complex and cumbersome in operation than the locking frame herein proposed.

The present drawer-locking apparatus, in contrast, is comprised of a rigid locking frame that, as a unit, slides laterally within a merchandise cabinet. In addition, the present invention is actuated by a locking frame lever which is remote from the drawers to be locked. In the past, such devices have been actuated either by closing a master drawer which, in turn, is locked by key, or by the movement of a key-locking mechanism itself.

SUMMARY AND OBJECTS OF THE INVENTION

The present drawer locking apparatus is adopted for use in a merchandise cabinet that includes a first area provided with an access door and a second area provided with at least one drawer having an outwardly facing front surface. The drawer locking apparatus comprises abutment means carried on the drawer and spaced inwardly from the drawer's front surface; a rigid locking frame slidably mounted within the second area of the cabinet and capable of limited lateral movement into and out of registry with the abutment means to selectively lock the drawer against opening movement; and a manually operable lever carried by the locking frame that extends into the first area and lies in the path of the access door for shifting the locking frame between drawer locking and unlocking positions.

The primary object of the present invention is to provide a rigidly constructed, reliable drawer locking device that selectively engages and disengages all of the drawers in one area of a merchandise cabinet simultaneously and that is actuated in cooperation with an access door provided for an area adjacent to the drawer-bearing area.

Another object of the present invention is to provide an improved drawer locking device simpler in design, materially stronger and, hence, more secure than heretofore possible.

Further objects and advantages are more readily apparent by reference to the following description and the accompanying drawing.

BRIEF DESCRIPTION OF THE DRAWINGS

FIG. 1 is a perspective view of a typical merchandise case in which the present drawer locking apparatus is installed;

FIG. 4 is an enlarged vertical sectional view, taken along line 4—4 of FIG. 2, of the engagement lever, upper portions of the locking frame, and the upper brackets which guide the drawer locking apparatus within the cabinet;

FIG. 5 is an enlarged vertical sectional view, taken along line 5—5 of FIG. 2, of a lower portion of the locking frame and surrounding cabinet structures; and FIG. 6 is an enlarged horizontal sectional view taken along line 6—6 of FIG. 2, of the vertical locking frame members and drawer brackets.

DETAILED DESCRIPTION OF THE PREFERRED EMBODIMENT

Figure 2:
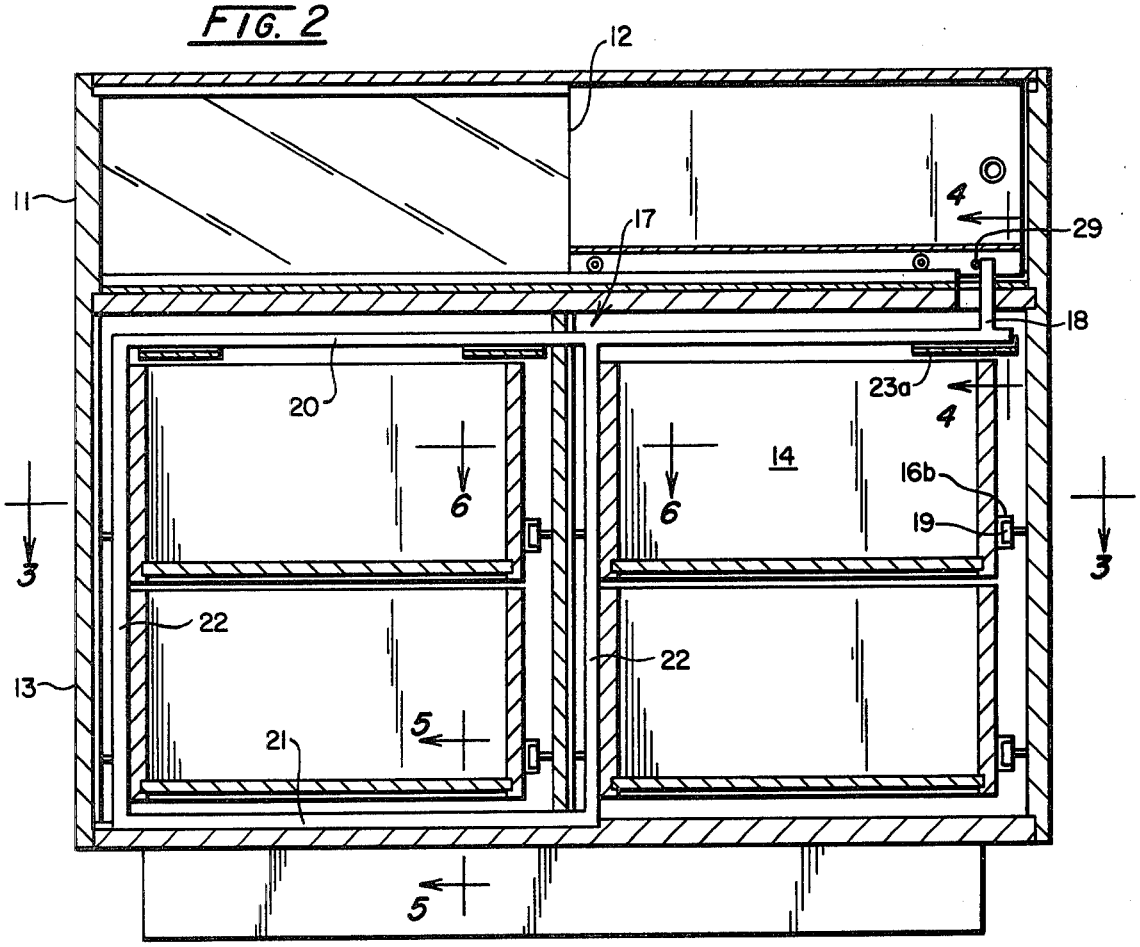
FIG. 2 is a vertical sectional view, taken along line 2—2 of FIG. 3, of the merchandise case, thereby exposing the present invention in its locked position.

The present drawer locking apparatus is adapted for use in a merchandise cabinet, generally designated 10 and illustrated in FIG. 1, which includes a first area 11 provided with an access door 12 and a second area 13 provided with one or more drawers 14. Typically, the first area 11 is glass-enclosed, with the exception of the access door 12, and is used to display merchandise. The second area 13 is ordinarily an opaque-walled structure and the drawer or drawers housed therein are used to store additional merchandise. Said drawers 14, as may be readily understood, are capable of inward and outward movement relative to the second area 13, and each is provided with outwardly facing front surface 15. Both the drawer fronts 15 and the access door 12 ordinarily lie on the operator's side of the merchandise cabinet 10.

Figure 3:
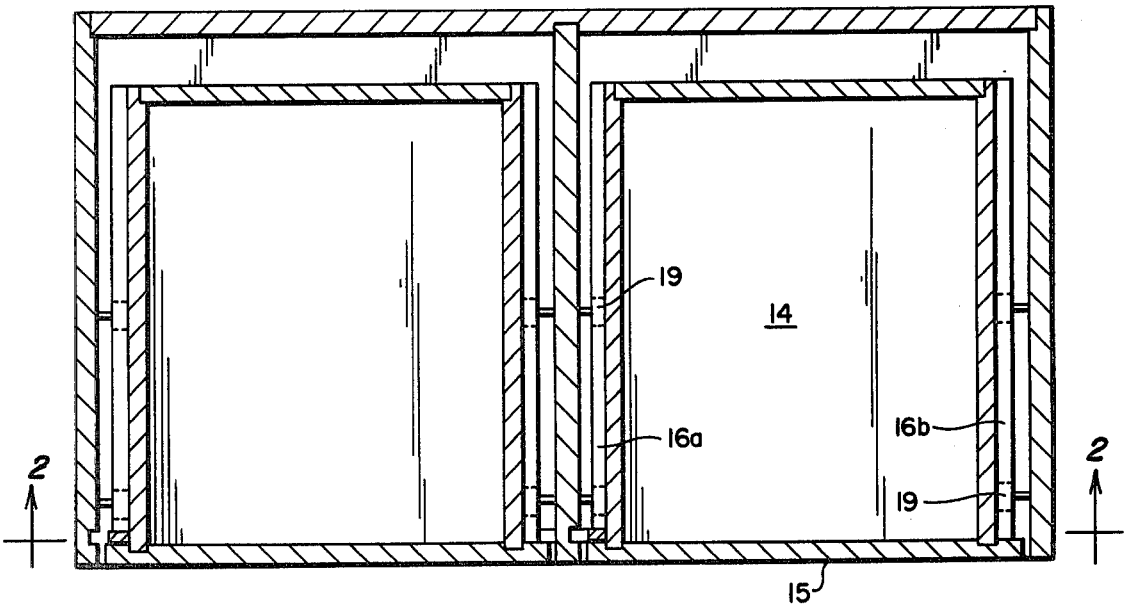
FIG. 3 is a horizontal sectional view, taken along line 3—3 of FIG. 2, of the vertical frame members of the invention and the cabinet.

The improved drawer locking apparatus is housed within the cabinet 10. It basically comprises drawer-mounted abutment means **16*a*, best illustrated in FIGS. 3 and 6 and, as indicated in FIG. 2, a rigid locking frame, generally designated 17, and an engagement lever or handle 18. Preferably, the locking frame 17 and the lever 18 lie on a single vertical plane perpendicular to the axis of movement of the drawers 14 and are located relatively close to the operator's side of the cabinet 10**.

The abutment means **16*a* are attached to each of the drawers 14 and are spaced inwardly from the drawer fronts 5. Preferably, the abutment means 16*a* is one of a pair of conventional, guide brackets 16*a* and 16*b* (FIG. 3), outwardly projecting from opposite lateral sides of each drawer 14. Said brackets may be mounted on rollers 19 (FIGS. 2 and 3) and typically serve as guides and positioning elements for the movement of the drawers 14 relative to the second area 13 of the merchandise cabinet 10. In the present embodiment, however, the guide bracket 16*a* cooperates advantageously with the locking frame 17**, thereby eliminating the need for separate, specialized abutment structures on the drawers.

The locking frame 17, illustrated in FIG. 2, is a rigid structure, preferably formed of longitudinally extending rods or bars, and is slidably mounted within the drawer-bearing second area 13 to move laterally into and out of registry with the abutment means 16*a* (FIG. 6). Preferably, the locking frame 17 comprises upper and lower horizontal members 20 and 21, respectively, and one or more vertical members 22. The upper and lower horizontal members 20 and 21 are positioned, respectively, above and below the drawers 14, and the vertical member or members 22 are rigidly attached at opposite ends to the upper and lower horizontal members 20 and 21. As indicated in FIG. 6, the vertical frame member 22 moves laterally into and out of the space between the drawer-mounted abutment means 16*a* and the drawer front 15 as the locking frame is shifted between locking and unlocking positions. Since the drawers 14 are paired in the present embodiment in vertically aligned rows, only one vertical member 22 is needed for each of said pairs. In effect, the vertical members 22 block the outward movement of the abutment bracket 16*a* when the locking frame is in its locked position. And, since the abutment bracket 16*a* is rigidly attached to the drawer 14, said drawer is prevented from opening.

As illustrated in FIG. 4, the locking frame 17 is preferably mounted for lateral sliding movement on one or more upper guide brackets 23. Each upper, angular bracket 23 is rigidly attached to a wall or frame member 24 which forms part of the second area 13 on the operator's side of the cabinet 10, and said bracket 23 is provided with an extended arm 23*a* having an upturned lip 23*b*. Said lip 23*b* provides a stationary guide for the upper horizontal member 20 of the locking frame 17, said horizontal member 20 advantageously including a longitudinally extending channel or groove 25 into which the bracket lip 23*b* may be inserted. Typically, two or three of the upper brackets 23 are spaced apart along the longitudinally extending wall 24 of the second cabinet area to carry and guide the upper frame member 20 (FIG. 2).

As illustrated in FIG. 5, a longitudinally extending channel 26 may be formed in a base member 27 of the second cabinet area 13. As may be readily perceived, said lower channel 26 guides the lateral movement of the horizontal frame member 21 slidably mounted therein.

The locking frame lever 18 is carried by the locking frame 17, and as seen in FIG. 2, extends from the upper horizontal frame member 20 into the path of movement of the access door 12 provided in the first area 11 of the merchandise case. The lever 18 is manually operable to shift the locking frame 17 between drawer locking and unlocking positions and, preferably, may also be moved to its drawer locking position by the access door 12. As indicated in FIG. 4, the access door 12 preferably comprises first and second panels 12*a* and 12*b*, slidably mounted in longitudinally extending grooves or tracks 28. One of the sliding panels 12*a* supports a transverse engagement pin 29 that extends through a pair of spaced-apart base-forming legs 30 and 31 in the panel 12*a*. The panel legs 30 and 31 are separated from each other by a distance slightly greater than the transverse thickness of the frame locking lever 18 and extend upwardly a distance slightly greater than the height of said lever. Accordingly, the engagement pin 29 is rigidly mounted between said legs 30 and 31 to intercept the lever 18 as the panel 12*a* passes over it. As the panel 12*a* is closed then, the engagement pin 29 will contact the lever 18. In addition, said lever 18 and the engagement pin 29 are so positioned that, with the door panel 12*a* completely closed, the pin 29 will have pushed the lever 18 and, consequently, the locking frame 17 to their drawer locking positions, as indicated in FIG. 2.

The improved drawer locking apparatus operates in the following manner. An attendant who wishes to completely secure the merchandise cabinet 10 initially closes all of the drawers 14. By so doing, he or she aligns the space between the drawer guide brackets 16*a* and the drawer fronts 15 with the vertical frame members 22 adjacent thereto. At this point, said vertical members 22 are laterally offset from the brackets 16*a* because the locking frame is in its drawer unlocking position. The attendant may then either manually move the locking frame lever 18 to shift the locking frame 17 laterally to its drawer locking position, or the operator may completely close the engagement pin bearing sliding panel 12*a* to accomplish the same result. The vertical frame members 22 are then in registry with the drawer guides 16*a*, thereby preventing the outward movement of the drawers 14. Next, the second sliding panel 12*b* is closed and the two panels 12*a* and 12*b* are locked by a suitable key-engaging device 32 (FIG. 1). To open the merchandise cabinet, the operator merely unlocks and opens the first sliding panel 12*a* and manually moves the locking frame lever 18 to shift said locking frame 17 to its drawer unlocking position. The vertical frame members 22 are then laterally offset from the drawer guides 16*a*; therefore the drawers 14 may be opened.

While a single preferred embodiment of the present drawer locking apparatus has been described in detail, the descriptions and illustrations above are not intended to unduly limit the present invention nor restrict the scope of the following claims.

I claim:

1. In a merchandise cabinet which includes a first area provided with an access door and a second area provided with at least one drawer having a front surface facing outwardly of said cabinet, a drawer locking apparatus comprising:

(a) abutment means carried on said drawer and spaced inwardly from the front surface thereof;

(b) a rigid locking frame slidably mounted within the second area of said cabinet and movable laterally as a unit into and out of registry with said abutment means for selectively locking said drawer against opening movement; and (c) a manually operable lever carried by said locking frame and extending into the first area of said cabinet in the path of movement of the access door, said lever being movable to shift said frame between drawer locking and unlocking positions.

2. A merchandise cabinet and drawer locking apparatus defined by claim 1, wherein the abutment means carried on said drawer comprises a guide bracket laterally projecting from one side of said drawer.

3. A merchandise cabinet and drawer locking apparatus defined by claim 1, wherein the locking frame comprises an upper and a lower horizontal frame member positioned, respectively, above and below the drawer, and at least one vertical frame member rigidly connected at its opposite ends to said upper and lower frame members, said vertical member moving laterally into and out of registry with the abutment means carried on said drawer for selectively locking said drawer against opening movement.

4. A merchandise cabinet and drawer locking apparatus defined by claim 1, wherein the second area of said cabinet is provided with a plurality of drawers and wherein said locking frame moves laterally into and out of registry with the abutment means carried on each of said drawers for selectively locking and unlocking all of said drawers simultaneously.

5. A merchandise cabinet and drawer locking apparatus defined by claim 1, wherein the access door of the first area of said cabinet engages the lever carried by the locking frame as said access door is closed to shift said frame to its drawer locking position.

* * * * *